United States Patent [19]

Rantanen

[11] Patent Number: 4,971,453

[45] Date of Patent: Nov. 20, 1990

[54] PORTABLE BAG AND METHOD FOR MAKING THE SAME

[75] Inventor: Keijo Rantanen, Pori, Finland

[73] Assignee: Oy W. Rosenlew AB, Finland

[21] Appl. No.: 421,283

[22] Filed: Oct. 13, 1989

Related U.S. Application Data

[63] Continuation of Ser. No. 198,471, May 25, 1988, abandoned.

[30] Foreign Application Priority Data

May 26, 1987 [FI] Finland ..... 872333

[51] Int. Cl.[5] ..... B65D 33/06

[52] U.S. Cl. ..... 383/20; 383/10; 383/17

[58] Field of Search ..... 383/20, 7, 9, 17, 18, 383/6; 493/226; 53/410

[56] References Cited

U.S. PATENT DOCUMENTS

| | | | |
|---|---|---|---|
| 3,066,845 | 12/1962 | Mattaway | 264/0.5 |
| 3,206,105 | 9/1965 | Smith | 383/10 |
| 3,462,069 | 8/1969 | Suominen | 383/10 |
| 3,548,723 | 12/1970 | Sengewald | 493/194 |
| 3,568,576 | 3/1971 | Lehmacher et al. | 493/194 |
| 3,688,974 | 9/1972 | Gennerich et al. | 383/10 |
| 4,031,815 | 4/1975 | Verbeke | 493/203 |
| 4,261,506 | 4/1981 | Scott | 383/22 |
| 4,610,029 | 9/1986 | Huhtala et al. | 383/10 |
| 4,811,419 | 3/1989 | Derby | 383/67 |

FOREIGN PATENT DOCUMENTS

| | | |
|---|---|---|
| 1511004 | 10/1969 | Fed. Rep. of Germany . |
| 2362613 | 6/1975 | Fed. Rep. of Germany . |
| 1357380 | 2/1964 | France . |
| 0062326 | 11/1986 | United Kingdom . |

*Primary Examiner*—Willis Little

*Attorney, Agent, or Firm*—Steinberg & Raskin

[57] ABSTRACT

A portable bag formed from a tubular blank of stitchable material includes an upper part provided with a carrying member, such as a carrying aperture or the like, a mantle and a bottom. In one embodiment, the upper part of the bag is formed by placing a reinforcing patch on an upper end region of the blank and folding the upper end region of the blank over itself as least one time to form at least two overlying fold regions with the reinforcing patch interposed between the at least two fold regions, and stitching a seam across the overlying fold regions and the reinforcing patch interposed therebetween to close the upper part of the bag. In another embodiment, the upper part of the bag is formed by first folding the upper end region of the blank over itself at least one time to form at least two overlying fold regions and then affixing a reinforcing patch over at least a first one of two opposed sides of the folded upper end region of the blank whereupon a seam is stitched across the overlying fold regions and the reinforcing patch affixed thereover to close the upper part of the bag. In this embodiment, the reinforcing patch may, alternatively, extend over both of the opposed sides of the folded upper end region of the blank which form the upper part of the bag.

6 Claims, 1 Drawing Sheet

PORTABLE BAG AND METHOD FOR MAKING THE SAME

This is a continuation of application Ser. No. 198,471, filed May 25, 1988, now abandoned.

BACKGROUND OF THE INVENTION

The present invention relates generally to the construction of portable bags and, more particularly, to portable bags formed of stitchable material comprising an upper part including a reinforcing patch and provided with a carrying member, such as a carrying aperture or the like, a mantle and a bottom, and wherein the upper part of the bag is folded at least one time and is closed by a transversely extending seam. The invention also relates to methods for making portable bags of this type.

A portable bag of the type with which the invention is concerned is disclosed in Finnish patent No. 65751. A plastic, plastic-coated, or plastic laminated bag is disclosed in this Finnish patent which includes an upper part which has been folded at least one time, the folded upper part being connected to the mantle by a reinforcing patch which at the same covers at least part of a seam with a view towards improving the strength of the bag.

The bag disclosed in Finnish patent No. 65751 corresponding to U.S. Pat. No. 4,610,029 is suitable for use in the storage and transport of bulk goods, such as chemicals, fertilizers, cement products or the like. Depending upon the nature and the intended use of the bulk goods carried by the bag, the bag can be constructed to store and transport bulk goods weighing in the range of between about 5 to 25 kg.

A drawback of the portable plastic bag disclosed in Finnish patent No. 65751 is that it is not suitable for use in the storage and transport of goods in which moisture can condense. Products of that type cannot be packaged in plastic bags due to the impermeability of the material from which the bag is constructed.

SUMMARY OF THE INVENTION

Accordingly, an object of the present invention is to provide new and improved portable bags and methods for making the same.

Another object of the present invention is to provide new and improved portable bags which are suitable for storage and transport of goods in which moisture can condense, and methods for making the same.

Still another object of the present invention is to provide new and improved portable bags which are reliable and durable in use, and methods for making the same.

Briefly, in accordance with one embodiment of the present invention, these and other objects are attained by constructing a portable bag from a tubular blank of stitchable material by first placing a reinforcing patch on an upper end region of the blank and then folding the upper end region of the blank over itself at least one time to form at least two overlying fold regions with the reinforcing patch interposed between them to thereby form the upper part of the bag, whereupon a seam is stitched across the overlying fold regions and reinforcing patch interposed between them to close the upper part of the bag.

In accordance with another embodiment of the invention, the bag is constructed by first folding the upper end region of the blank over itself at least one time to form at least two overlying fold regions whereupon a reinforcing patch is situated and affixed over at least a first one of the two opposed sides of the folded upper end region of the blank to form the upper part of the bag whereupon a seam is stitched across the overlying fold regions and reinforcing patch affixed thereover to close the upper part of the bag. The reinforcing patch may be placed so that it extends over a top edge of the bag and so that it overlies and is affixed to both of the opposed sides of the folded upper end region of the blank.

A portable bag constructed in accordance with the invention provides numerous significant advantages. The reinforcing patch renders the bag both reliable and durable while being carried The bag may be formed of a breathable material, such as paper, which provides an advantage not obtainable by similar bags found in the prior art. Indeed, a bag in accordance with the invention may be formed of any stitchable material or combination thereof. Materials particularly suitable for the bag are HDPE or polypropylene fabrics. A bag in accordance with the invention is therefore particularly suited for storage and transport of products in which moisture may condense. The bottom of a bag incorporating the construction of the invention may comprise any conventional design. For example, the bottom may be straight and stitched closed in a manner known in the art, or may include a valve construction by means of which the bag can be filled with its contents. The bag may be emptied of its contents by removing the stitched seam in the upper part of the bag.

It is particularly advantageous to use a reinforcing patch formed of textile fabric in a bag construction in accordance with the invention. Particularly advantageous materials are, for example, woven polypropylene fabric, woven HDPE fabric or textile fabric material designated by the trademark TYVEK, or the like.

DESCRIPTION OF THE DRAWINGS

A more complete appreciation of the present invention and many of the attendant advantages thereof will be readily understood by reference to the following detailed description when considered in connection with the accompanying drawings, which illustrate embodiments to which the invention is not meant to be exclusively confined, in which:

FIG. 3*a* is an axonometric view of the bag illustrated in schematic form, in FIG. 2*a.

DETAILED DESCRIPTION OF THE PREFERRED EMBODIMENTS

Figure 3A:
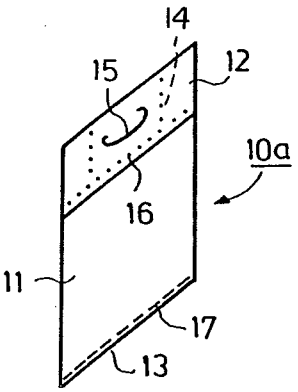
Figure 2A:
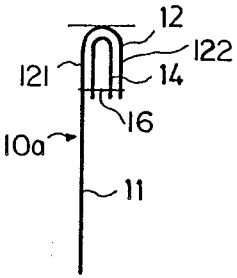
FIG. 2*a* is a schematic side elevation view of a bag constructed in accordance with one embodiment of the invention.

Referring now to the drawings wherein like reference characters designate identical or corresponding parts throughout the several views, and more particularly to the bag designated 10*a* shown in FIGS. 2*a* and 3*a*, the bag 10*a* is formed from a tubular blank 10 (FIG. 1) of stitchable material and comprises an upper part 12, a mantle 11, and a bottom 13. The upper part 12 is provided with carrying means 15 such, for example, as a carrying aperture of the like.

The upper part 12 of bag 10*a* includes a reinforcing patch 14 previously placed on an upper end region 12' (FIG. 1) of the blank 10, and at least two overlying fold regions 121 and 122 (FIG. 2*a*) of the upper end region 12' of the blank 10. The fold regions 121 and 122 are formed by folding the upper end region 12' of blank 10 over itself at least one time after the reinforcing patch 14 has been placed on the upper end region of the blank. The reinforcing patch 14 becomes interposed between the overlying fold regions 121 and 122 as best seen in FIG. 2*a*. The overlying fold regions 121 and 122 and the reinforcing patch 14 interposed between them are stitched together by a stitched seam 16 to close the upper part of the bag.

Figure 1:
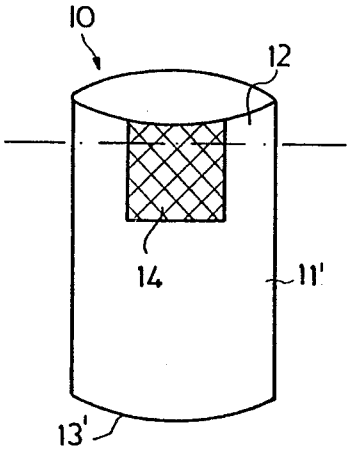
FIG. 1 is an axonometric view of a blank used in the construction of a portable bag in accordance with the invention.

Thus, in accordance with the method of the invention, the portable bag 10*a* is constructed from the tubular blank 10 of stitchable material by first placing the reinforcing patch 14 on an upper end region 12' of the blank as seen in FIG. 1. The upper end region 12' of the blank is then folded over itself at least one time to form at least two overlying fold regions 121 and 122 with the reinforcing patch 14 interposed between them to thereby form the upper part 12 of the bag 10*a*. A seam 16 is then stitched across the at least two overlying fold regions and the reinforcing patch interposed between to close the upper part of the bag. The lower end region of the blank may then be closed by providing a stitched seam 17 at the bottom end region 13' of blank 10 to form the bottom 13 of bag 10*a*.

Figure 2B:
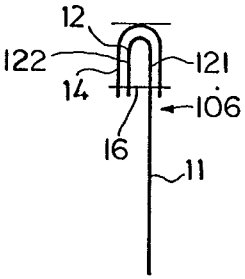
FIG. 2*b* is a schematic side elevation view of a bag constructed in accordance with a second embodiment of the invention.
Figure 3B:
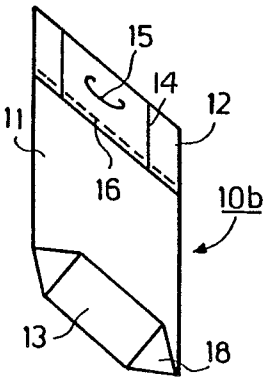
* and FIG. 3*b* is an axonometric view of the bag illustrated in schematic form in FIG. 2*b*.

Referring now to the construction of bag 1O*b* shown in FIGS. 2*b* and 3*b*, the construction differs from that of bag 10*a* in that the upper end region of a tubular blank formed of stitchable material is first folded over itself to form at least two overlying fold regions whereupon the reinforcing patch is then placed and affixed over the folded upper end regions of the blank. In particular, bag 1O*b* comprises an upper part 12 provided with carrying means 15, such as a carrying aperture or the like, a mantle 11 and bottom 13. In this embodiment, the bottom 13 comprises a filling valve 18 for filling bulk goods into the completed bag 1O*b*. The upper part 12 includes at least two overlying fold regions 121 and 122 (FIG. 2*b*) formed by folding the upper end region of the blank over itself at least one time. A reinforcing patch is then placed on and affixed to, such as by glue, at least a first one of the two opposed sides of the folded upper end region of the blank. In the embodiment illustrated in FIG. 2*b*, the reinforcing patch 14 extends over the top edge of the bag and is affixed over both of the opposed sides of the folded upper end region of the blank. The overlying fold regions 121 and 122 and the reinforcing patch 14 affixed thereover are stitched with a stitched seam 16 to close the upper part 12 of the bag 10*b*.

In both embodiments of the bags 10*a* and 10*b*, the mantle 11 generally comprises a plurality of material layers such, for example, as six separate paper layers. In certain applications, one of the layers may comprise a special material, such as bitumen-impregnated paper or fabric. Since bags constructed in accordance with the invention have a greater strength due to the reinforcing patch 14, a bag in accordance with the invention may be constructed omitting one or more of the material layers whereby considerable cost savings are achieved.

Obviously, numerous modifications and variations of the present invention are possible in light of the above teachings. Therefore, it is to be understood that within the scope of the claims appended hereto, the invention may be practiced otherwise than as specifically disclosed herein.

What is claimed is:

1. A method of making a portable bag from a tubular blank of stitchable material, comprising the steps of:

folding an upper end region of said blank over itself at least one time to form at least two overlaying fold regions to form an upper part of the bag;

placing a reinforcing patch on said upper end region of said blank, interposed between said at least two fold regions and over both of said opposed sides of said upper regions of said blank;

stitching a seam across said at least two overlying fold regions and passing over said reinforcing patch to close said upper part with said reinforcing patch affixed to said folded upper end regions of the bag; and closing a lower end region of said blank to form a lower part of the bag.

2. The method of claim 1 wherein said reinforcing patch is formed of a textile fabric material.

3. Method according to claim 1 and including the steps of affixing a carrying means and a mantel to the upper part of said blank.

4. A method of making a portable bag from a tubular blank of stitchable material, comprising the steps of:

folding an upper end region of said blank over itself at least one time to form at least two overlying fold regions to form an upper part of the bag;

placing a reinforcing patch on said upper end region of said blank, extending over the top of said bag and over both of said opposed sides of said folded upper end regions of said blank;

stitching a seam across said at least two overlying fold regions and passing over said reinforcing patch to close said upper part with said reinforcing patch affixed to said folded upper end regions of the bag; and closing a lower end region of said blank to form a lower part of the bag.

5. A portable bag formed by a tubular blank of stitchable material, further comprised by:

at least two overlaying fold regions of blank folded over itself at least one time to form an upper part of the bag:

a reinforcing patch placed on said upper end region of said blank, interposed between said at least two fold regions and over both of said opposed sides of said folded upper end regions of said blank;

a seam stitched across said at least two overlying fold regions and passing over said reinforcing patch to close said upper part with said reinforcing patch affixed to said folded upper end regions of the bag; and a lower end region of said blank closed to form a lower part of the bag.

6. A portable bag formed by a tubular blank of stitchable material, further comprised by:

at least two overlaying fold regions of blank folded over itself at least one time to form an upper part of the bag;

a reinforcing patch placed on said upper end region of said blank, extending over the top of said bag and over both of said opposed sides of said folded upper end region of said blank;

a seam stitched across said at least two overlying fold regions and passing over said reinforcing patch to close said upper part with said reinforcing patch affixed to said folded upper end regions of the bag; and a lower end region of said blank closed to form a lower part of the bag.

* * * * *